US005240408A

United States Patent [19]

Kenjiro et al.

[11] Patent Number: 5,240,408

[45] Date of Patent: Aug. 31, 1993

[54] GAS LIGHTER WITH SAFETY DEVICE

[75] Inventors: Kenjiro Uematsu; Yosimitu Kaga; Masaki Saito, all of Shizuoka, Japan

[73] Assignee: Tokai Corporation, Kanagawa, Japan

[21] Appl. No.: 988,808

[22] Filed: Dec. 10, 1992

[30] Foreign Application Priority Data

Jan. 13, 1992 [JP] Japan ..... 4-040078
Oct. 7, 1992 [JP] Japan ..... 4-268779

[51] Int. Cl.[5] ..... F23D 11/36

[52] U.S. Cl. ..... 431/153; 431/277; 222/153; 222/402.11

[58] Field of Search ..... 431/153, 277, 255, 267, 431/131, 253, 344; 222/153, 402.11, 402.12, 509, 518

[56] References Cited

U.S. PATENT DOCUMENTS

| | | | |
|---|---|---|---|
| 3,898,031 | 8/1975 | Rusakowicz | 431/254 |
| 4,424,920 | 1/1984 | Tada | 222/153 |
| 4,784,602 | 11/1988 | Nitta | 431/153 |
| 4,786,248 | 11/1988 | Nitta | 431/153 |
| 4,832,596 | 5/1989 | Morris, Sr. | 431/153 |
| 4,859,172 | 8/1989 | Nitta | 431/153 |
| 4,904,180 | 2/1990 | Nitta | 222/153 |
| 4,921,420 | 5/1990 | Johnston | 431/153 |
| 5,002,482 | 3/1991 | Fairbanks et al. | 431/153 |
| 5,074,781 | 12/1991 | Fujita | 431/277 |
| 5,120,215 | 6/1992 | Nollas | 431/153 |
| 5,145,358 | 9/1992 | Shike et al. | 431/277 |

FOREIGN PATENT DOCUMENTS

| | | |
|---|---|---|
| 1-178456 | 12/1989 | Japan . |
| 3-25215 | 2/1991 | Japan . |
| 3-501647 | 4/1991 | Japan . |
| 3-35971 | 7/1991 | Japan . |

*Primary Examiner*—James C. Yeung
*Attorney, Agent, or Firm*—Brumbaugh, Graves, Donohue & Raymond

[57] ABSTRACT

A gas lighter with a safety device which is composed of a lock lever and a resilient leaf. The resilient leaf is defined, on the upper portion of a lighter body and on the path of a depressible actuating means, by a pair of slits formed parallel to each other and longitudinally. The resilient leaf, which is slidably surrounded with the lock lever, is at the upper end thereof incurved towards the lighter body. When the lock lever is positioned at the lowermost end of the slits, i.e., a locked position, the incurved portion of the resilient leaf is engaged with a recess at the lowermost end of the actuating means, thereby preventing the depression of the actuating means. When the lock lever is thrust uppermost along the slits, i.e., up to an unlocked position, the incurved end of the resilient leaf is forcibly straightened, whereby the disengaged actuating means can be depressed.

14 Claims, 9 Drawing Sheets

GAS LIGHTER WITH SAFETY DEVICE

BACKGROUND OF THE INVENTION

1. Field of the Invention

This invention relates to a gas lighter ignitable upon depression of an actuating means and, more particularly to a lighter with a safety device which remains deactivated by the engagement of a resilient member with an actuating means but can be activated by rendering the resilient member deformed.

2. Description of the Prior Art

Though a gas lighter is a convenient tool which can easily be ignited by the depression of the service end of an actuating lever, it can be a safety hazard for those who, like children, are unfamiliar with the proper use of the lighter. In addition, the lighter may be ignited by the unintentional depression of the service end happenly upon contact with stuffs.

In response to the demands for a gas lighter which is improved in safety in such a manner that inadvertent ignition by those who are unfamiliar with the proper use of the lighter can surely be prevented and the unintentional ignition can be prevented, child resistant gas lighters with several types of safety devices have already been known. Most of the safety devices built into these child resistant gas lighters have a lock mechanism which prevents depression of the actuating lever and which must be released to allow the actuating lever to be depressed. However, any of the conventional-type child resistant gas lighters will have drawbacks in their usage and thus it is desirable that the gas lighter be improved for practical use.

For instance, as disclosed in U.S. Pat. Nos. 4,859,172, 4,786,248, and 4,784,602 and Japanese Utility Model Publication No. 3(1991)-35971, any one of the disclosed safety devices is provided with a lock member for deterring depression of the actuating lever. Since the lock member is manually movable between a locked position and a released position, the lock member tends to stay at the released position without a manual recovery from the released position to the initial position after the use of the lighter, whereby the safety device remains unlocked. Leaving the lock member at the released position permits the actuating lever to be depressed, rendering the safety device inoperable. Specifically then, to ensure safety, the existing safety devices always require a manual re-locking operation after the use of the lighter with the lock mechanism unlocked, and hence there were expected further improvements of the lock mechanism in terms of safety.

To solve the drawbacks set forth above, there have been proposed, as a safety device having a lock member to impede the depression of the actuating lever, safety devices with what is called an auto-return function wherein the lock member automatically returns to the locked position in response to the ignition operation after the lock member has been manually moved to the released position. U.S. Pat. Nos. 5,002,482, and 3,898,031, and Japanese Unexamined Patent Publication No. 3(1991)-25215, for instance, disclose such safety devices as having the autoreturn function which allows automatic return of the lock member to the locked position in response to the ignition operation. With these safety devices, however, releasing the lock mechanism is only achieved by the motion of a finger along an L-shaped path, thereby resulting in the lock mechanism being inferior, in terms of operability, in the ease of releasing the lock member such that a lighter of this type generally requires operation with a single finger, such as a thumb, thus leading to different results depending on the users. Therefore, safety devices of this type can be said to be disadvantageous in practical use. Further, the operation of these safety devices is unreliable because of a probability that the lock member will return to the locked position by its own reactive force which is due to the resilience of the material constituting the lock member.

Furthermore, there have been proposed safety devices wherein the lock member is released by the motion of a finger not along the L-shaped path, but along a simple linear path, but any of those have drawbacks in practical use. The safety device as disclosed in Japanese Patent Publication of Translated Version (PCT) No. 3(1991)-501647, for instance is provided with an automatic return function wherein the part of a lock member being composed of a spring is moved along an arcuate path to the released position and held there, then it automatically returns to the locked position in response to the ignition operation. In this type of safety device, the arrangement for guiding the release of the spring-like lock member is not satisfactory, and accordingly the lock member cannot be steadily released. This adversely affects the ease of releasing the lock mechanism in the gas lighter, which is generally operated with a single finger, and, as with the preceding example, the resulting operations will be different depending on the users. Since the lock member itself is formed of a spring, the lock member may become deformed and cause failure of the lock mechanism after repeated use of the lighter.

In the safety device disclosed in U.S. Pat. No. 4,832,596, the lock member is moved to the released position along a linear path, but automatically returns to the initial position unless it is held at the locked position with a finger other than the one used for actuating the ignition mechanism. Thus, the lock member cannot steadily be released. This adversely affects the ease of releasing the lock mechanism in a gas lighter, which is generally operated with a single finger, e.g. the thumb, and, as with the preceding examples, leads to different operational results depending on the users.

In order to overcome such problems, there has been proposed an autoreturn safety device in which the lock member is moved along a linear path to the released position, thereby facilitating the release of the lock mechanism, and at the same time, the lock mechanism can be held in the released position with the finger which actuates the ignition mechanism, thus not requiring another finger. However, the safety device also has drawbacks in its practical use. That is, in the safety device disclosed in Japanese Unexamined Utility Model Publication No. 1(1989)-178456, the lock member is incorporated in the actuating lever which is actuated to ignite the lighter and the actuating lever can be operated with use of the same finger that has been used in releasing the lock member, i.e. the thumb which is generally used in an ignition operation, thus facilitating the releasing operation. However, when the actuating lever is actuated with the same finger (usually the thumb) which previously moved the lock member to the released position, the lock member may inadvertently be released from the thumb and may return to the locked position. Accordingly, also in this safety device, the lock member cannot be steadily released. This adversely affects the ease of releasing the lock mechanism in the gas lighter, which is generally operated with a single finger, e.g. the thumb, and, as with the preceding examples, this leads to different operational results depending on the users.

As can be seen from the description above, any one of the existing child resistant safety devices has drawbacks in practical use, and hence there has been a demand for a child resistant safety device which is improved in both safety and operability.

Further, in manufacturing gas lighters with such a safety device, it is required to rationalize the assembling steps, to improve assembling accuracy, thereby further enhancing the handling of the safety device, and to reduce the manufacturing cost.

SUMMARY OF THE INVENTION

In view of the foregoing observations and description, the primary object of this invention is to provide a gas lighter with a safety device, which enables the lighter to be ignited by the depression of an actuating means and the automatic recovery of a lock lever to a locked position associated with the action of the actuating means, wherein, when not in use, the lighter is locked to prevent the ignition whilst, when in use, the lighter is released from the locked state by the actuation of the lock lever.

Another object of this invention is to provide a gas lighter with a safety device which can prevent the lock lever from being left at the unlocked position, and which can ensure the lock of the actuating means when the lighter is not in use.

A further object of this invention is to provide a gas lighter with a safety device simple in structure and inexpensive to manufacture.

To these ends, according to one aspect of this invention, there is provided a gas lighter with a safety device including a lighter body containing fuel gas, a fuel supply means for supplying the fuel gas contained in the lighter body to a nozzle at a regulated flow rate, an ignition means for igniting the fuel gas evolved from the nozzle, and a depressible actuating means for opening and closing the fuel flow channel of the fuel supply means connected to the nozzle, wherein the improvement comprises:

a pair of parallel slits longitudinally formed, at the upper end of the lighter body, to constitute a resilient leaf therebetween, the upper part of the resilient leaf being incurved to a locked position situated below a part of the depressible actuating means, and a lock member being slidably engaged with the resilient leaf in such a manner as to travel longitudinally along the slits between the lowermost and the uppermost ends thereof, wherein, at the lowermost end, the lock member allows the upper part of the resilient leaf to be incurved to the locked position so that the depression of the actuating means is prevented whilst, at the uppermost end, the lock member holds the resilient leaf outside the path of the actuating means to allow the depression thereof, whereby the resilient leaf is allowed to be incurved to prevent the depression of the actuating means when the lock member is slidably thrust down to the lowermost end of the slits, and whereby the resilient leaf is held at a position outside the path of the depressible actuating means when the lock member is thrust upwardly to the uppermost end.

Accordingly, as the lock member is forced upwardly along the slits, the resilient leaf is straightened against the elasticity thereof, so that it is in alignment with the surface of the lighter body. Eventually, the resilient leaf is kept apart from the actuating means, thereby allowing the depression of the actuating means. The depression of the actuating means forces the lock lever downwardly along the slits, which in turn entails the recovery of the resilient leaf to the state partially incurved toward the lighter body, thereby preventing the depression of the actuating means and rendering the lighter inactive.

According to a second aspect of this invention, there is provided a lighter with a safety device including a lighter body containing fuel gas, a fuel supply means for supplying the fuel gas contained in the lighter body to a nozzle at a regulated flow rate, an ignition means for igniting the fuel gas evolved from the nozzle, and a depressible actuating means for opening and closing the fuel flow channel of the fuel supply means connected to the nozzle, wherein the improvement comprises:

a resilient leaf means defined on an upper portion of a lighter body by a pair of slits formed in the path of the depressible actuating means, wherein the resilient leaf means at the upper end thereof is incurved towards the lighter body in such a manner as to deter the depression of the depressible actuating means by the engagement of the incurved end of the resilient leaf means with a portion of the bottom surface of the actuating means; and a lock means surrounding the resilient leaf means and being provided along the slits in a slidable fashion between a locked position, located at the lowermost end of the slits, and an unlocked position, located at the uppermost end of the same, wherein at the unlocked position the lock lever means forcibly straightens, longitudinally, the incurved resilient leaf means so as to disengage the resilient leaf means from the depressible actuating means, and wherein the lock lever means is thrust downwardly upon contact with a part of the lower surface of the depressible actuating means, whereby the lock means, located at the locked position, is returned to the locked position associated with the depression of the depressible actuating means.

In a preferred mode, the resilient leaf means may be provided with a stopper which hinders the upthrust of the lock lever when engagged with the lock lever between the locked position and the unlocked position. This stopper may be arranged to be disengaged from the lock lever by the inward pressing of the lock lever.

In the case of a discharge-ignition type gas lighter, the foregoing depressible actuating means may be constituted in the form of an operating cap which includes a piezoelectric generator, whilst in the case of a flint type gas lighter the ignition means may be composed of a file and a flint and the depressible actuating means may be constituted of a gas lever.

According to a gas lighter with a safety device exemplifying this invention, while the lock means is situated at the locked position, i.e., the lowermost end of the slits, the incurved end of the resilient leaf makes an abutment with a portion at the bottom end of the depressible actuating means, thereby preventing the depression of the depressible actuating means and rendering the lighter locked. Accordingly as the lock lever is thrust upwardly along the slits, the incurved resilient leaf is straightened against the resilience thereof, and the actuating means is disengaged from the resilient leaf, thereby rendering the actuating means depressible. Fuel gas resulting from the depression of the actuating means is ignited by the ignition means. In conjunction with the depression of the actuating means, the lock means is thrust down to the locked position located at the lowermost end of the slits, whereupon the straightened resilient leaf resumes its original position with the result that the depression of the actuating means is prevented which, in turn, deters the inadvertent ignition of the lighter. Thus, according to this invention, a gas lighter which is much superior in safety will be provided.

As previously described, the stopper is provided on the resilient leaf which prevents the upthrust of the lock means between the locked position and the unlocked position when engaged with the lock means. The inward press of the lock means only disengages the lock lever from the stopper. Since such an arrangement requires two-staged unlocking operations, the gas lighter with this lock mechanism will be difficult to activate for those who are unfamiliar with the proper use of the lighter, and will ensure the prevention of inadvertent ignition of the lighter.

DETAILED DESCRIPTION OF THE PREFERRED EMBODIMENTS

Figure 1:
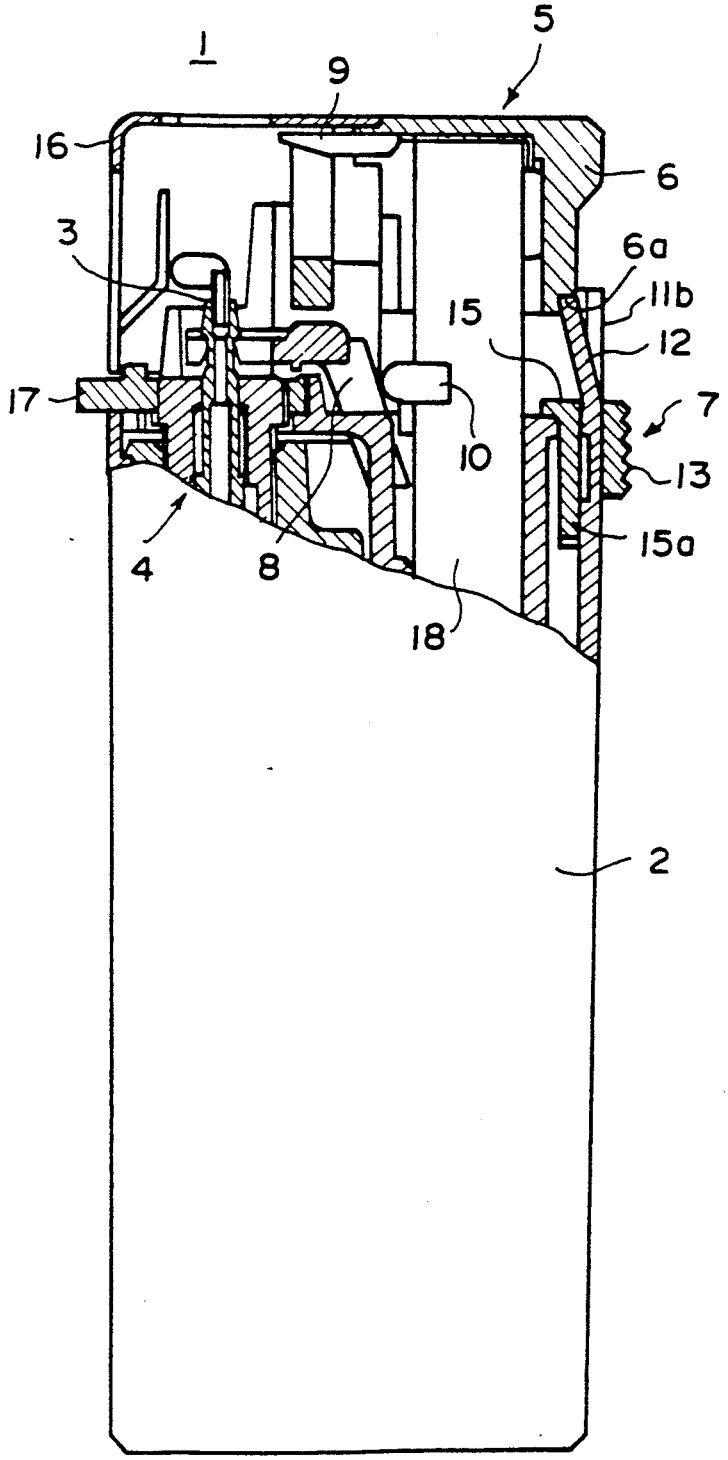
FIG. 1 is a vertical side cross-sectional view showing a chief portion of a gas lighter with a safety device according to a first embodiment of this invention.

Referring to the accompanying drawings, preferred embodiments of this invention will be described in detail hereinbelow.

First Embodiment

A gas lighter 1 with a safety device shown in FIGS. 1 through 5, according to this invention, is provided with a lighter body 2 containing fuel gas, a fuel supply means 4 having a nozzle 3 for evolving fuel gas, an operation cap 6 integrated with an actuating means 5, which strikes a piezoelectric generator to produce sparks, and a lock lever 7 provided at an upper part of the lighter body 2 for rendering the operation cap 6 locked or unlocked.

The lighter body 2, substantially in the form of a rectangular parallelepiped, is made of synthetic resin, and contains fuel gas such as butane. The lighter body 2 accommodates a known fuel supply means 4 for discharging the contained fuel gas at a regulated flow rate, and the nozzle 3, provided on top of the fuel supply means 4, the nozzle 3 projecting out of the top of the lighter body 2. Disposed parallel with the upper surface of the lighter body 2 is a gas lever 8 which is, at one end thereof, engageably connected with the nozzle 3. This gas lever 8 is L-shaped, and supports at one bored end thereof the nozzle 3. The other end of the gas lever 8 extends down and in towards the lighter body 2, and the gas lever is rockably supported at the bent portion thereof.

Disposed at the end of the lighter body, opposite to the nozzle 3, is the operation cap 6 on the upper part of the lighter body 2. This operation cap 6 is slidable downwards, and incorporates a piezoelectric generator 18 for igniting the fuel gas evolved from the nozzle 3 upon depression of the cap 6 downwards. The upper part of the operation cap 6 is also provided with a discharge electrode 9 connected to the piezoelectric generator 18, and this generator 18 is provided with a lever press 10 oriented opposite to the gas lever 8.

A pair of parallel slits 11*a* and 11*b* are longitudinally formed downwards at a predetermined length on the upper part of the side wall of the lighter body 2 to constitute a resilient leaf 12 which is surrounded by the lock lever 7.

Figure 3:
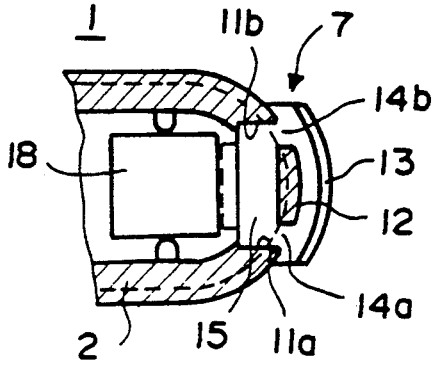
FIG. 3 is a horizontal cross-sectional view showing a chief portion of the lighter shown in FIG. 1.

As shown in FIG. 3, the lock lever 7 is comprised of a curved thumb plate 13 used when thrusting the lock lever 7 between the locked position and the unlocked position; a pair of bridges 14*a* and 14*b* stretched through the slits 11*a* and 11*b*; and a receiving element 15 for affording stability to the thumb plate 13 and receiving the bottom end of the depressed operation cap 6. The receiving element 15 is provided with, at the bottom end thereof, a downward extension, which constitutes a leg 15*a*.

The resilient leaf 12 is at an upper end thereof deformable in towards the lighter body 2, but at the bottom end thereof fixedly integrated with the lighter body. In a released state, the upper end of the resilient leaf 12 is incurved towards the lighter body 2. As shown in FIG. 1, complementarily formed at the bottom end of the operation cap 6 is a recess 6*a* to be engaged with the uppermost end of the resilient leaf 12.

The lock lever 7 has an opening which is constituted by the combination of the thumb plate 13, the bridges 14*a* and 14*b*, and the receiving element 15 and through which the resilient leaf 12 passes. Both sides of the thumb plate 13 of the lock lever 7 extend sideways further than the bridges 14*a* and 14*b*, and the inner surfaces of the side portions, extended sideways from the slits 11*a* and 11*b*, are in contact with the exterior surface of the lighter body 2. This causes the incurved end of the resilient leaf 12 to be straightened when the lock lever 7 is thrust upwards, whilst, when the lock lever is positioned at the lowermost end of the slits 11*a* and 11*b*, this causes the incurved end of the resilient leaf to be released. Reference numeral 16 designates a windproof cap, and 17, a fire extension regulator ring.

The operation of the lighter 1, with the safety device having the aforementioned structure, will now be described in detail.

Figure 2:
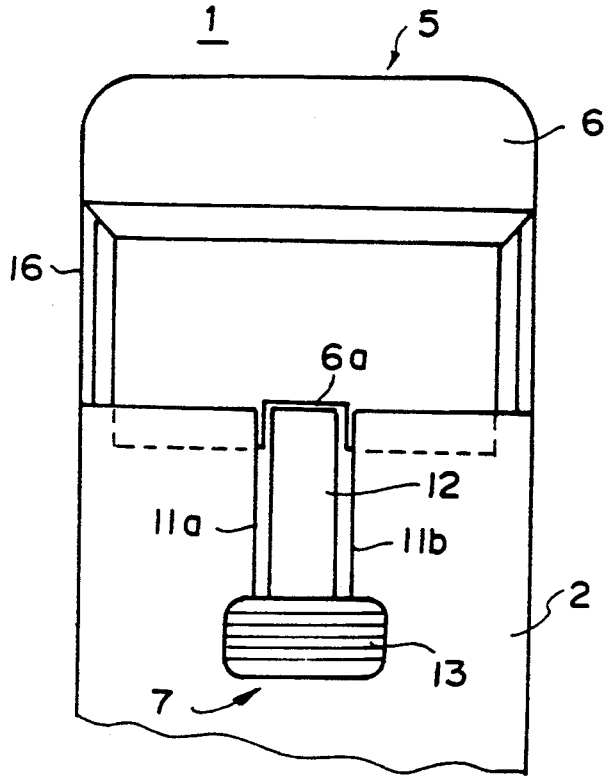
FIG. 2 is a rear view showing a chief portion of the lighter shown in FIG. 1.

As seen from FIGS. 1 and 2, in the normal state when the lock lever is positioned at the locked position, i.e., the lowermost end of the slits 11*a* and 11*b*, the resilient leaf 12 is incurved towards the lighter body 2. In this state, when depression of the operation cap 6 is attempted, the engagement between the upper end of the resilient leaf 12 and the recess 6*b* of the operation cap 6 deters the prevention of the operation cap 6, thereby preventing the piezoelectric generator 18 from receiving an impact which causes the generator to produce sparks. Thus, the safety is assured even if the gas lighter 1 is operated by those who are not familiar with the proper use thereof.

Figure 4:
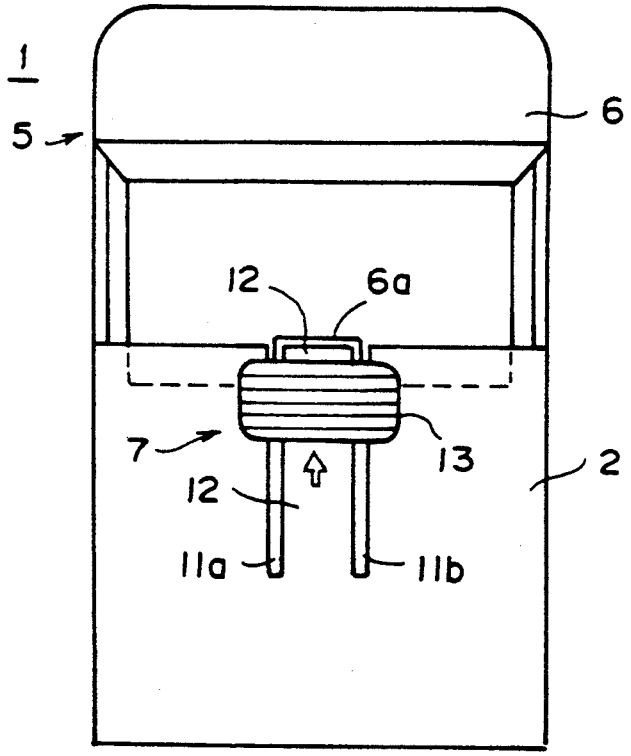
FIG. 4 is a rear view showing a chief portion of the lighter, shown in FIG. 2, in an unlocked state.

When the gas lighter 1 is in use, the lock lever 7 is raised, with the thumb plate 13, to the uppermost end of the lighter body 2 along the slits 11*a* and 11*b*, i.e., up to the unlocked position, as shown in FIG. 4. The resilient leaf 12, incurved towards the lighter body 2, is progressively straightened as the receiving element 15 of the lock lever 7 is thrust upwardly. At the unlocked position, the resilient leaf 12 is finally rendered in alignment with the top end of the lighter body 2, and the receiving element 15 is situated in proximity to the uppermost end of the lighter body 2. The straightening of the resilient leaf 12 causes the upper end of the resilient leaf 12, in engagement with the recess 6*a* at the bottom end of the operation cap 6, to be disengaged, which permits the depression of the operation cap 6.

Figure 5:
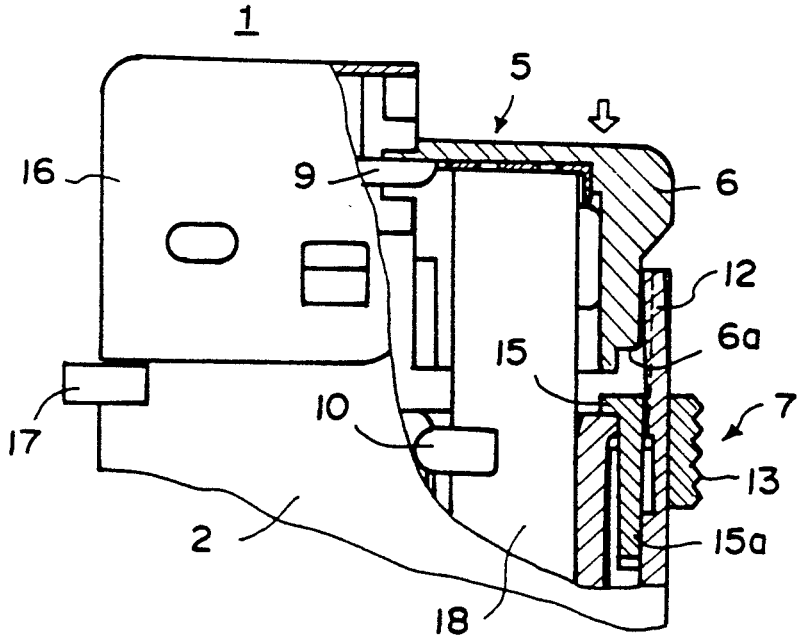
FIG. 5 is a side cross-sectional view showing a chief portion of the lighter, shown in FIG. 1, which is being ignited.

As seen from FIG. 5, when the operation cap 6 is depressed, the bottom end thereof is brought in contact with the upper surface of the receiving element 15 of the lock lever 7. Further depression of the operation cap 6 causes the receiving element 15 to be lowered, which forces the lock lever 7 to the locked position located at the lowermost end of the slits 11*a* and 11*b*.

At the same time, the depression of the operation cap 6 provides an impact to the piezoelectric device 18, which in turn activates the discharge electrode 9 to produce sparks. Associated with this, the lever press 10 thrusts the gas lever 8 forward, which in turn lifts the nozzle 3. Thereby, the nozzle 3 evolves the fuel gas, and the gas is then ignited. The shift of the lock lever 7 to the locked position results in the resilient leaf obtaining, at the upper end thereof, an inward curvature toward the lighter body, but this time this upper end makes contact with the side surface of the operation cap 6.

Upon release of a finger from the operation cap 6, in order to extinguish the fire, the operation cap 6 is lifted and returns to its original position with the help of the resilient force of a non-illustrated spring. The resilient leaf 12 is concurrently incurved toward the lighter body 2, and then the upper end of the same is engaged with the recess 6*a* at the lower end of the operation cap 6, whereby the lighter automatically returns to the locked state.

Second Embodiment

Figure 6:
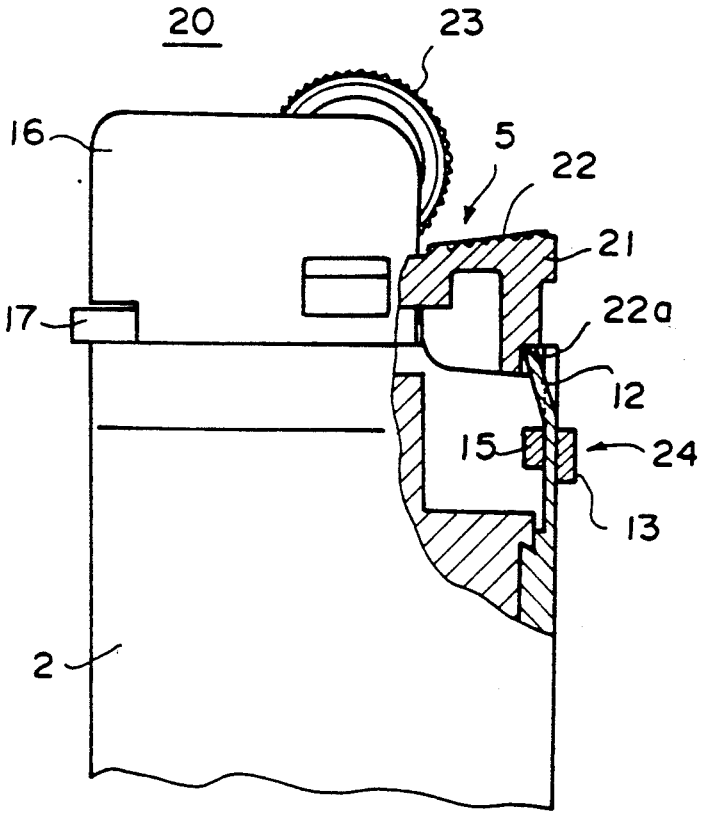
FIG. 6 is a side cross-sectional view showing a chief portion of a gas lighter with a safety device according to a second embodiment.

FIG. 6 shows a lighter 20 with a safety device according to another embodiment of this invention, wherein the lighter employs an ignition system different from that of the first embodiment. Like reference numerals are provided to like features in the first embodiment, and detailed explanation thereof will be omitted here for clarity.

In this embodiment, the lighter is called a flint type lighter, and is provided with an ignition means which includes a non-illustrated flint and a file 23. An ignition lever 21 for regulating the evolution of gas is rockably supported, as the actuating means 5, at the upper part of the lighter body 2 by a non-illustrated pivot. The ignition lever 21, at one end thereof, engageably supports the nozzle 3 in the same manner as shown in FIG. 1, and, at the rear-side end thereof, i.e., at the bottom end of an operation means 22, is provided a recess 22*a*. This recess 22*a* is engaged with the incurved resilient leaf 12, in the same fashion as in the first embodiment, that is, towards the lighter body 2.

The lock lever 24 surrounding the resilient leaf 12 is essentially the same in structure as that in the first embodiment. The lock lever 24 goes up and down along the slits 11*a* and 11*b* depending on the operation of the thumb plate 13. When the lock lever is situated at the locked position, i.e., the lowermost end of the slits, the released resilient leaf 12 is engaged with the recess 22*a* of the operation means 22, whilst at the unlocked position, i.e., the uppermost end of the slits, the incurved resilient leaf 12 is straightened, so that the upper end of the resilient leaf 12 is disengaged from the recess 22*a*. In the case of this lock lever 24, however, the receiving element 15 has no extended portion such as the leg 15*a* in the first embodiment.

When the lighter 20 is in use, as with the first embodiment, the lock lever 24 is first lifted to the unlocked position at the uppermost end of the slits so that the upper end of the resilient leaf 12 is straightened. With this result, the recess 22*a* at the bottom end of the operation means 22 is disengaged from the upper end of the resilient leaf 12, thereby rendering the ignition lever 21 depressible. The lighter is then ignited when the ignition lever 21 is depressed in association with the rotation of the file 23.

Together with the depression of the ignition lever 21, the lock lever 24 is thrust downwards to the locked position with the receiving element 15 thereof being in contact with the bottom end of the operation means 22. When the ignition lever 21 is returned to its original elevated position to extinguish the fire, the incurved end of the resilient leaf 12 is automatically engaged with the recess 22*a* at the bottom end of the operation means 22, thereby rendering the lighter locked and the ignition lever 21 undepressible.

Third Embodiment

FIGS. 7 through 11 illustrate a gas lighter 30 with a safety device according to a third embodiment of this invention, wherein the lighter employs an ignition system different from that of the first embodiment. Like reference numerals are provided to like features in the first embodiment, and detailed explanation thereof will be omitted here for clarity.

Like the first embodiment, the gas lighter 30 with a safety device, according to this embodiment, is composed of the lighter body 2, the fuel supply means 4 which incorporates the nozzle 3 and the gas lever 8, the operation cap 6 integrated with the actuating means 5, which actuating means strikes the piezoelectric generator 18 to produce sparks, and a lock lever 31 for rendering the operation cap 6 locked or unlocked. In the lighter body 2, a container for containing fuel gas is constituted by the combination of a tank 2*a* with a top cover 2*b* disposed on the upper surface of the tank. Separated from the tank, an intermediate case 2c is connectively provided on top of the top cover.

Figure 8:
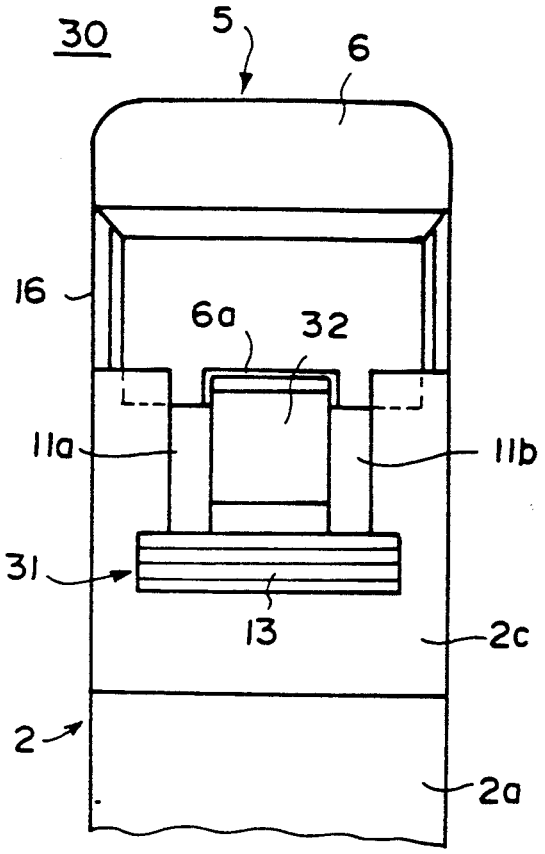
FIG. 8 is a rear view showing the gas lighter shown in FIG. 7.

In FIG. 8, on the side surface of the intermediate case 2c, continuously stretching from the side wall of the tank 2a, a pair of slits 11a and 11b are formed downwards, longitudinally, at a predetermined length so as to constitute a resilient leaf 32 which is surrounded by a lock lever 31.

Figure 10:
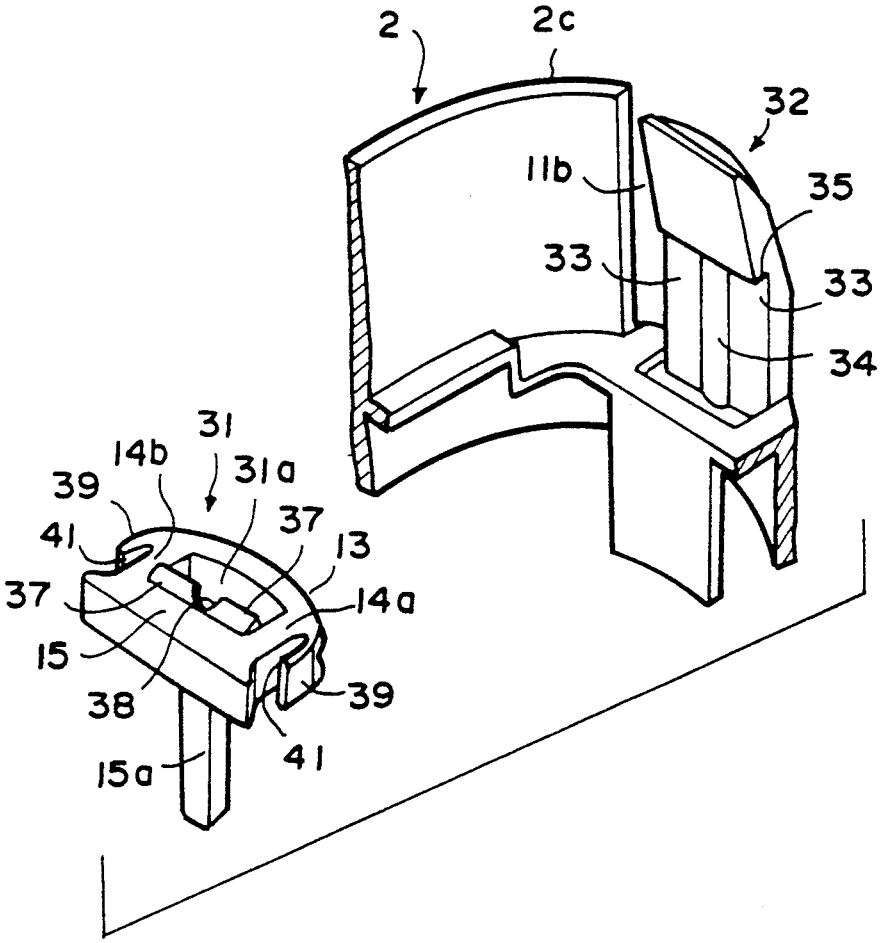
FIG. 10 is an exploded perspective view showing a resilient leaf and a lock lever of the lighter shown in FIG. 7.

In this embodiment, the upper end of the resilient leaf 32 is incurved towards the lighter body 2, and is engaged with the recess 6a at the bottom of the operation cap 6 so as to hinder the depression of the operation cap 6 when it is in a disengaged state. The inner surface of the resilient leaf 32 is provided, remotely from the upper end thereof, with a pair of guide channels 33 which stretch downwards. The guide channels 33 are divided at the center thereof by a raised rail 34. In FIG. 10, formed at the uppermost end of the guide channels is a stopper 35 which makes an abutment with the uppermost end of an engaging element 37 of the lock lever 37, as will be described later. The remaining portion of the resilient leaf 32 above the stopper 35 is incurved.

Figure 9:
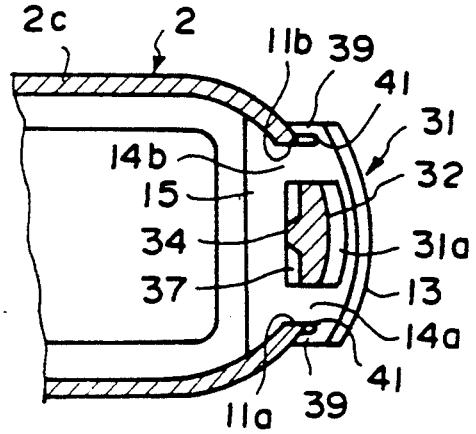
FIG. 9 is a horizontal cross-sectional view showing a chief portion of the gas lighter shown in FIG. 7.

As seen from FIGS. 9 and 10, this lock lever 31 is further provided with, in the same manner as the previous embodiment, the thumb plate 13, a pair of bridges 14a and 14b which pass through the slits 11a and 11b, and the receiving element 15 which makes a contact with the lowermost end of the operation cap 6. An opening 31a, through which the resilient leaf 32 travels, of the resilient leaf 32 is provided with at the inside thereof, the engaging element 37, which makes a slidable contact with the guide channels 33, and a longitudinal flute 38, with which the raised rail 34 fits. Provided on the bottom surface of the receiving element 15 is a downwardly extended portion 15a, and the flue 38 of the receiving element longitudinally stretches further along this extended portion 15a without an interruption. The engaging element 37 is upgraded towards the opening, and the counterpart stopper 35, at the uppermost end of the channels 33 of the resilient leaf 32, is, at the innermost end thereof, angularly cornered so that the engaging element can be securely engaged with the stopper.

Both sides of the thumb plate 13 of the lock lever 31 deformably extend in the shape of leg so as to make a slidable contact with the exterior surface of the intermediate case 2c outside the slits 11a and 11b. A gap 41 between the thumb plate 13 and the deformable leg affords a resiliency to the deformable leg 39. When the thumb plate 13 is interiorly pressed from the outside, the pair of deformable legs 39 receive an outwardly curved shape, thereby enabling the inward deflection of the receiving element 15. The dimension of the opening 31a is selected so that a fan-and-strip-shaped clearance can be produced between the exposed side surface of the resilient leaf 32 and the curved inside surface of lock lever 31.

Figure 7:
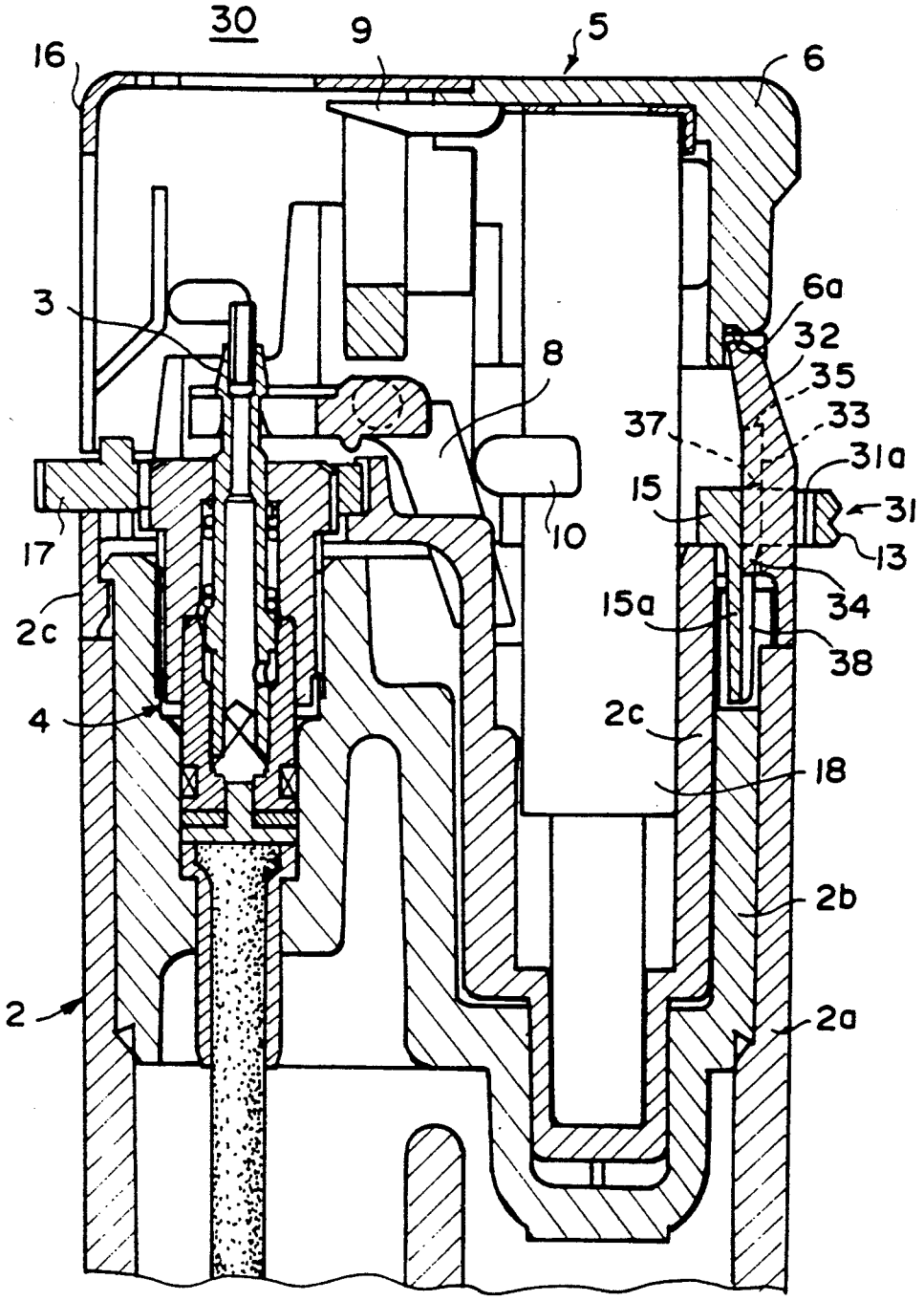
FIG. 7 is a side cross-sectional view showing a chief portion of a gas lighter with a safety device according to a third embodiment.

With reference to FIG. 7, the operation of the gas lighter, according to this embodiment, will now be described. In a normal state in which the lock lever 31 is situated at the locked position located at the lowermost end of the slits 11a and 11b, the upper end of the resilient leaf 32 is engaged with the recess 6a of the operation cap 6, thereby preventing the depression of the cap 6. Moreover, in this locked state, a play for the lock lever 31, i.e., a locked range, is longitudinally secured between the uppermost end of the engaging element 37 and the uppermost end of the guide channels 33.

Figure 11A:
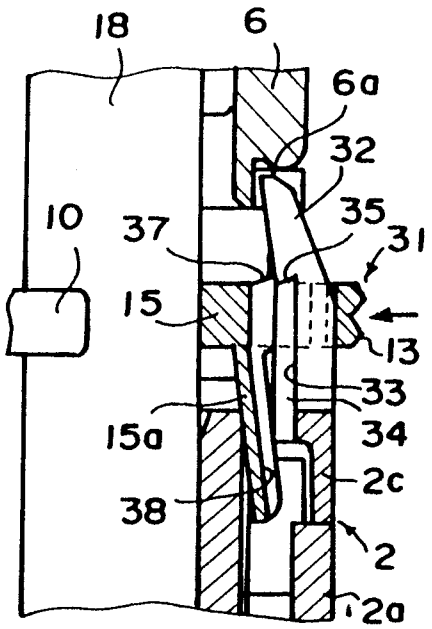
FIGS. 11A, 11B and 11C are cross-sectional views showing various activated states of a chief portion of the safety device shown in FIG. 7.
Figure 11B:
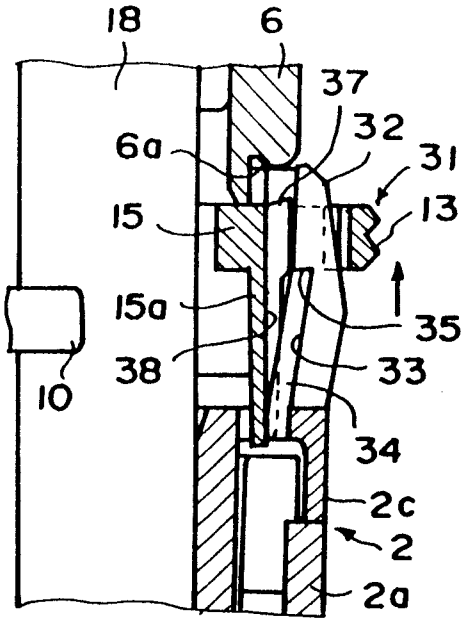

When the user uses the gas lighter 30, the lock lever 31 is thrust upward, as shown in FIG. 11B, to the unlocked position with the thumb plate 13 being pressed inwards, as shown in FIG. 11A.

In this course of action, the inward pressing of the lock lever 31 renders the deformable legs 39 on both sides of the thumb plate 13 exteriorly curved, so that the receiving element 15 of the lock lever 31 deflects inwardly. As a result of this, the uppermost end of the engaging element 37 is inwardly kept away from the stopper 35, thereby allowing the elevation of the lock lever. A contact between the engaging element 37 of the lock lever 31 and the inside surface of the incurved portion of the lock lever, i.e., the upper area above the stopper 35, renders the incurved upper portion of the resilient leaf 32 straightened, which in turn disengages the incurved portion from the recess 6a of the operation cap 6. Eventually, the lighter enters an unlocked state in which the operation cap 6 is depressible.

Figure 11C:
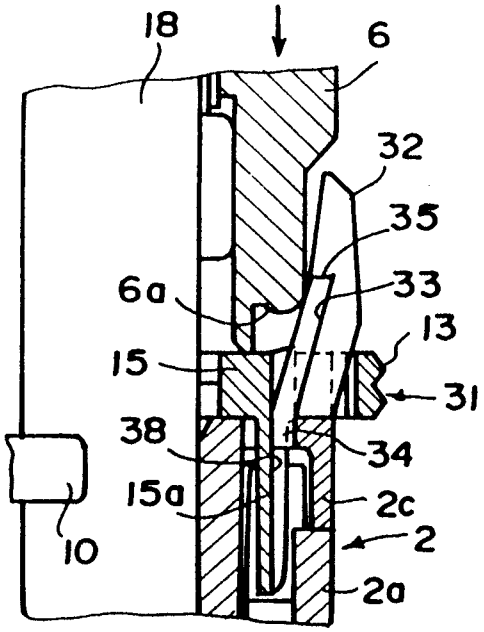

When the operation cap 6 is depressed as shown in FIG. 11C, the lighter is ignited. Concurrently, the lowermost end of the operation cap 6, in contact with the receiving element 15, forces downwardly the lock lever 31 to the locked position at the lowermost end of the slits. Then, in turn, the straightened portion of the resilient leaf 32 returns to its initial state, but that portion is brought in contact with the side wall of the operation cap 6.

Releasing the finger from the operation cap 6 allows the return of the same to its original elevated position, whereupon the upper end of the resilient leaf 32 receives an incurved shape in such a manner as to be engaged with the recess 6a of the operation cap 6, whereby the lighter automatically returns to the locked state.

Fourth Embodiment

Figure 12:
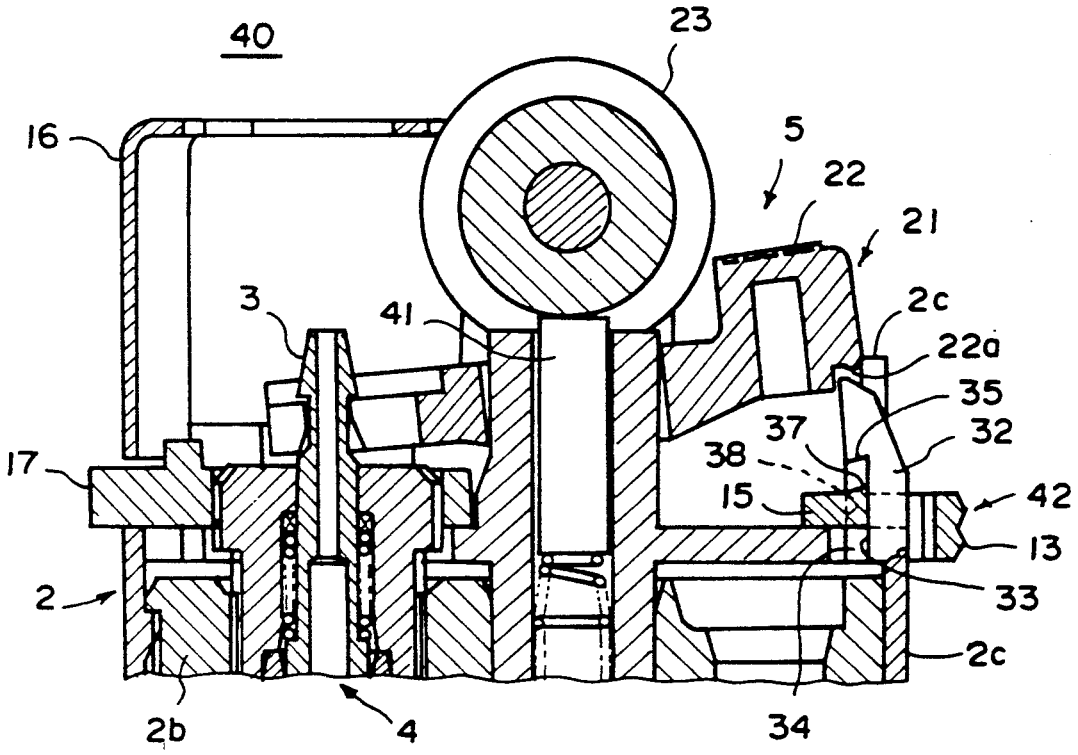
FIG. 12 is a cross-sectional view showing a chief portion of a gas lighter with a safety device according to a fourth embodiment of this invention.

FIG. 12 shows a lighter 40 with a safety device according to another embodiment of this invention, wherein the lighter is a flint type gas lighter equipped with the safety device which is the same as is employed in the third embodiment. Like reference numerals are provided to like features in the first embodiment, and detailed explanation thereof will be omitted here for clarity.

The gas lighter, according to this embodiment, includes a flint 43 and the file 23. In this lighter, the ignition lever 21 at one end thereof engageably supporting the nozzle 3 is rockably supported, and the recess 22a of the operation means 22 is engaged with the upper end of the resilient leaf 32 which is formed as in the previous embodiment. A lock lever 42, through which the resilient leaf 32 travels, is the same in structure as the other switches of the previous embodiments, but different only in that the receiving element 15 lacks the leg 15a.

When the gas lighter 40 is in use, the lock lever 42 is pressed inwardly, in the same fashion as in the previous embodiment, and then thrust upwards to the unlocked position located at the uppermost end of the slits, with the engaging element 37 of the lock lever 42 being disengaged from the stopper 35. After the upper end of the resilient leaf 32 is straightened, the ignition lever 21 is depressed rotating the file 23, so that the lighter is ignited. In association with the depression of the ignition lever 21, the lock lever 42 is forced down to the locked position. Upon arrival of the ignition lever 21 at its initial elevated position, the incurved portion of the resilient leaf 32 is engaged with the recess 22*a* of the operation means 22, thereby preventing the depression of the ignition lever 21. Thus, the gas lighter automatically returns to the locked state.

It should be noted that the lock lever, which is disposed at the rear of the lighter body 2 throughout the aforementioned embodiments, may be disposed on either side surface of the lighter body 2.

Several embodiments of this invention have now been described in detail. It is to be noted, however, that these descriptions of specific embodiments are merely illustrative of the principles underlying the inventive concept. It is contemplated that various modifications of the disclosed embodiments, as well as other embodiments of the invention will, without departing from the spirit and scope of the invention, be apparent to persons skilled in the art.

What is claimed is:

1. A gas lighter with a safety device including a lighter body containing fuel gas, a fuel supply means for supplying the fuel gas contained in the lighter body to a nozzle at a regulated flow rate, an ignition means for igniting the fuel gas evolved from the nozzle, and a depressible actuating means for opening and closing the fuel flow channel of the fuel supply means connected to the nozzle, wherein the improvement comprises:

a pair of parallel slits longitudinally formed, at the upper end of the lighter body, to constitute a resilient leaf therebetween, the upper part of the resilient leaf being incurved to a locked position situated below a part of the depressible actuating means, and a lock member being slidably engaged with the resilient leaf in such a manner as to travel longitudinally along the slits between the lowermost and the uppermost ends thereof, wherein, at the lowermost end, the lock member allows the upper part of the resilient leaf to be incurved to the locked position so that the depression of the actuating means is prevented whilst, at the uppermost end, the lock member holds the resilient leaf outside the path of the actuating means to allow the depression thereof, whereby the resilient leaf is allowed to be incurved to prevent the depression of the actuating means when the lock member is slidably thrust down to the lowermost end of the slits, and whereby the resilient leaf is held at a position outside the path of the depressible actuating means when the lock member is thrust upwardly to the uppermost end.

2. A gas lighter with a safety device as defined in claim 1, wherein the resilient leaf is provided with a stopper for interrupting the upthrust of the lock means with the engagement with the lock means between the locked position and the unlocked position, and the stopper is disengaged from the lock lever when the lock lever is inwardly pressed.

3. A gas lighter with a safety device as defined in claim 1, wherein the depressible actuating means is an operation cap which includes a piezoelectric generator.

4. A gas lighter with a safety device as defined in claim 1, wherein the ignition means includes a file and a flint, and the depressible actuating means is a gas lever.

5. A lighter with a safety device including a lighter body containing fuel gas, a fuel supply means for supplying the fuel gas contained in the lighter body to a nozzle at a regulated flow rate, an ignition means for igniting the fuel gas evolved from the nozzle, and a depressible actuating means for opening and closing the fuel flow channel of the fuel supply means connected to the nozzle, wherein the improvement comprises:

a resilient leaf means defined on an upper portion of a lighter body by a pair of slits, which are formed in the direction of displacement of the depressible actuating means, the resilient leaf means, at the upper end thereof, being incurved towards the lighter body in such a manner as to deter the depression of the depressible actuating means by the engagement of the incurved end of the leaf means with a portion of the bottom surface of the actuating means; and a lock means surrounding the resilient leaf means and being provided along the slits in a slidable fashion between the locked position at the lowermost end of the slits and the unlocked position at the uppermost end of the same, wherein at the unlocked position the lock lever means forcibly straightens, longitudinally, the incurved resilient leaf means so as to disengage the resilient leaf means from the depressible actuating means, and wherein the lock lever means is lowered upon contact with a part of the lower surface of the depressible actuating means, whereby the lock means, located at the locked position, is returned to the locked position associated with the depression of the depressible actuating means.

6. A gas lighter with a safety device as defined in claim 5, wherein the resilient leaf is provided with a stopper for interrupting the upthrust of the lock means with the engagement with the lock means between the locked position and the unlocked position, and the stopper is disengaged from the lock lever when the lock lever is inwardly pressed.

7. A gas lighter with a safety device as defined in claim 5, wherein the depressible actuating means is an operation cap which includes a piezoelectric generator.

8. A gas lighter with a safety device as defined in claim 5, wherein the ignition means includes a file and a flint, and the depressible actuating means is a gas lever.

9. A gas lighter with a safety device including a lighter body containing fuel gas, a fuel supply means for supplying the fuel gas contained in the lighter body to a nozzle at a regulated flow rate, an ignition means for igniting the fuel gas evolved from the nozzle, and a depressible actuating means for opening and closing the fuel flow channel of the fuel supply means connected to the nozzle, wherein the improvement comprises:

a pair of parallel slits longitudinally formed, at an upper end of the lighter body, to constitute a resilient leaf therebetween, the upper part of the resilient leaf being incurved to a locked position situated below a part of the depressible actuating means, wherein the resilient leaf is provided with a stopper for interrupting the upthrust of the lock means with the engagement with the lock means between the locked position and the unlocked position, and wherein the stopper is disengaged from the lock lever when the lock lever is inwardly pressed, and a lock means being slidably engaged with the resilient leaf in such a manner as to travel longitudinally along the slits between a lowermost end thereof, where the lock means allows the upper part of the resilient leaf to be incurved to the locked position so as to prevent the depression of the actuating means, and the uppermost end thereof, where the lock means holds the resilient leaf outside the path of the actuating means to allow the depression thereof, whereby the resilient leaf is allowed to be incurved to prevent the depression of the actuating means when the lock means is slidably lowered to the lowermost end of the slits, and whereby the resilient leaf is held at a position outside the path of the depressible actuating means when the lock means is slidably elevated to the uppermost end.

10. A gas lighter with a safety device as defined in claim 9, wherein the depressible actuating means is an operation cap which includes a piezoelectric generator.

11. A gas lighter with a safety device as defined in claim 9, wherein the ignition means includes a file and a flint, and the depressible actuating means is a gas lever.

12. A lighter with a safety device including a lighter body containing fuel gas, a fuel supply means for supplying the fuel gas contained in the lighter body to a nozzle at a regulated flow rate, an ignition means for igniting the fuel gas evolved from the nozzle, and a depressible actuating means for opening and closing the fuel flow channel of the fuel supply means connected to the nozzle, wherein the improvement comprises:

a resilient leaf means defined on an upper portion of a lighter body by a pair of slits, which are formed in the direction of displacement of the depressible actuating means, the resilient leaf means, at the upper end thereof, being incurved towards the lighter body in such a manner as to deter the depression of the depressible actuating means by the engagement of the incurved end of the leaf means with a portion of the bottom surface of the actuating means, wherein the resilient leaf is provided with a stopper for interrupting the upthrust of a lock means with the engagement with the lock means between the locked position and the unlocked position, and the stopper is disengaged from the lock lever when the lock lever is inwardly pressed; and the lock means surrounding the resilient leaf means and being provided along the slits in a slidable fashion between the locked position at the lowermost end of the slits and the unlocked position at the uppermost end of the same, wherein at the unlocked position the lock lever means forcibly straightens, longitudinally, the incurved resilient leaf means so as to disengage the resilient leaf means from the depressible actuating means, and wherein the lock lever means is lowered upon contact with a part of the lower surface of the depressible actuating means, whereby the lock means, located at the locked position, is returned to the locked position associated with the depression of the depressible actuating means.

13. A gas lighter with a safety device as defined in claim 12, wherein the depressible actuating means is an operation cap which includes a piezoelectric generator.

14. A gas lighter with a safety device as defined in claim 12, wherein the ignition means includes a file and a flint, and the depressible actuating means is a gas lever.

* * * * *

UNITED STATES PATENT AND TRADEMARK OFFICE

CERTIFICATE OF CORRECTION

PATENT NO. : 5,240,408

DATED : August 31, 1993

INVENTOR(S) : Kenjiro Uematsu et al.

It is certified that error appears in the above-identified patent and that said Letters Patent is hereby corrected as shown below:

On the Title Page, under item [19], change "Kenjiro" to --Uematsu--.

Signed and Sealed this

Twenty-third Day of August, 1994

Bruce Lehman

*Attest:*

BRUCE LEHMAN

*Attesting Officer*

*Commissioner of Patents and Trademarks*